US007607886B2

(12) United States Patent
Hsu et al.

(10) Patent No.: US 7,607,886 B2
(45) **Date of Patent: *Oct. 27, 2009**

(54) HEAT-DISSIPATING DEVICE

(75) Inventors: Wei-Chun Hsu, Taoyuan (TW); Shun-Chen Chang, Taoyuan (TW); Wen-Shi Huang, Taoyuan (TW); Hsiou-Chen Chang, Taoyuan (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 318 days.

This patent is subject to a terminal disclaimer.

(21) Appl. No.: 11/150,178

(22) Filed: Jun. 13, 2005

(65) Prior Publication Data

US 2005/0260070 A1 Nov. 24, 2005

Related U.S. Application Data

(63) Continuation-in-part of application No. 10/848,074, filed on May 19, 2004, now Pat. No. 7,241,110.

(30) Foreign Application Priority Data

Jun. 18, 2004 (TW) ..... 93117623 A

(51) Int. Cl.
*F04D 29/42* (2006.01)

(52) U.S. Cl. ..... 415/206; 416/201 A; 416/203

(58) Field of Classification Search ..... 416/180, 416/183, 175, 203, 198 R, 200 R, 201 A, 416/211.1; 415/211.1
See application file for complete search history.

(56) References Cited

U.S. PATENT DOCUMENTS 1,427,391 A * 8/1922 Johns ..... 416/183
1,622,930 A * 3/1927 Von Karman et al. ..... 416/183
1,959,703 A * 5/1934 Birmann ..... 416/183
2,469,125 A * 5/1949 Meisser ..... 416/183
2,480,807 A * 8/1949 De Vlieg ..... 409/84
2,859,933 A * 11/1958 Whitaker ..... 416/183
RE27,038 E * 1/1971 Newland ..... 416/242
3,588,280 A * 6/1971 Yedidiah ..... 416/200 R
3,782,851 A * 1/1974 Hackbarth et al. ..... 415/198.1
3,893,817 A * 7/1975 Hackbarth et al. ..... 29/889.4
3,904,308 A * 9/1975 Ribaud ..... 415/143
3,918,841 A * 11/1975 Kida et al. ..... 416/183
3,958,905 A * 5/1976 Wood ..... 416/183
4,125,344 A * 11/1978 Tiefenbacher ..... 416/183
4,175,911 A * 11/1979 Tiefenbacher ..... 416/183
4,183,719 A * 1/1980 Bozung ..... 416/183
4,483,664 A 11/1984 Armbruster (Continued)

FOREIGN PATENT DOCUMENTS

CN 1208822 A 2/1999

(Continued)

*Primary Examiner*—Richard Edgar
(74) *Attorney, Agent, or Firm*—Birch, Stewart, Kolasch & Birch, LLP

(57) ABSTRACT

A heat-dissipating device includes a housing having at least one opening, and a rotor disposed in the housing and having a base, a hub, a first set of blades disposed around the hub, and a second set of blades disposed on the base for increasing air volume and stabilizing a blast pressure of airflow passing through the heat-dissipating device.

22 Claims, 8 Drawing Sheets

U.S. PATENT DOCUMENTS

| | | | | | |
|---|---|---|---|---|---|
| 4,502,837 | A | * | 3/1985 | Blair et al. | 415/198.1 |
| 4,653,976 | A | * | 3/1987 | Blair et al. | 415/1 |
| 4,900,228 | A | * | 2/1990 | Yapp | 416/183 |
| 5,188,508 | A | * | 2/1993 | Scott et al. | 415/206 |
| 5,213,473 | A | * | 5/1993 | Fiala | 416/183 |
| 5,605,444 | A | * | 2/1997 | Paton et al. | 416/183 |
| 6,499,953 | B1 | * | 12/2002 | Bellerose et al. | 416/175 |
| 6,508,626 | B1 | * | 1/2003 | Sakurai et al. | 416/180 |
| 6,540,479 | B2 | * | 4/2003 | Liao et al. | 415/199.5 |
| 6,565,326 | B2 | * | 5/2003 | Horng et al. | 417/44.1 |
| 6,572,336 | B2 | * | 6/2003 | Horng et al. | 416/183 |
| 6,589,013 | B2 | | 7/2003 | Abdallah | |
| 6,655,918 | B2 | * | 12/2003 | Otsuka | 416/175 |
| 6,832,895 | B2 | * | 12/2004 | Yoshioka et al. | 416/183 |
| 7,025,569 | B2 | * | 4/2006 | Chang et al. | 416/183 |
| 7,083,386 | B2 | * | 8/2006 | Horng et al. | 416/175 |
| 7,134,839 | B2 | * | 11/2006 | Horng et al. | 415/199.4 |
| 2002/0122724 | A1 | * | 9/2002 | Tseng | 416/175 |
| 2003/0063975 | A1 | * | 4/2003 | Horng et al. | 416/183 |
| 2003/0147760 | A1 | * | 8/2003 | Chiang | 417/423.1 |
| 2003/0185682 | A1 | * | 10/2003 | Lei et al. | 416/183 |
| 2004/0131465 | A1 | * | 7/2004 | Ochiai et al. | 415/206 |

FOREIGN PATENT DOCUMENTS

| | | | | |
|---|---|---|---|---|
| CN | 2343395Y | A | | 10/1999 |
| CN | 1369671 | A1 | | 9/2002 |
| CN | 2533304Y | A1 | | 1/2003 |
| CN | 2549227Y | A1 | | 5/2003 |
| DE | 20309621U | A1 | | 9/2003 |
| EP | 0 971 131 | A2 | | 1/2000 |
| JP | 57-008398 | A | | 1/1982 |
| JP | 57020596 | A | * | 2/1982 |
| JP | 58079604 | A | * | 5/1983 |
| JP | 59103999 | A | * | 6/1984 |
| JP | 59113202 | A | * | 6/1984 |
| JP | 60001302 | A | * | 1/1985 |
| JP | 60-035198 | A | | 2/1985 |
| JP | 60128903 | A | * | 7/1985 |
| JP | 60-130114 | A | | 8/1985 |
| JP | 61-78776 | A | | 5/1986 |
| JP | 06-257595 | A | | 9/1994 |
| JP | 07-211961 | A | | 8/1995 |
| JP | 3074771 | A | | 11/2000 |
| JP | 2002070791 | A1 | | 3/2002 |
| JP | 3096854 | A1 | | 7/2003 |
| JP | 2004-169712 | A1 | | 6/2004 |
| TW | 449248Y | A | | 8/2001 |
| TW | 540642Y | A1 | | 7/2003 |

* cited by examiner

HEAT-DISSIPATING DEVICE

FIELD OF THE INVENTION

The present invention is a continuation-in-part application of the parent application bearing Ser. No. 10/848,074 and filed on May 19, 2004 now U.S. Pat. No. 7,241,110. The present invention relates to a heat-dissipating device, and in particular to a high-pressure centrifugal fan with a composite blade structure.

DESCRIPTION OF THE RELATED ART

In FIG. 1, a conventional blower 1 includes a frame 10, a motor 11, an impeller 12 and a cover 13. The frame 10 includes an opening 101 as an air outlet and the cover 13 has a circular opening 131 as an air inlet. The way from the air inlet to the air outlet constitutes an airflow passage. The motor 11 is disposed on a base 102 of the frame 10 to drive the impeller 12. The impeller 12 includes a hub 121, an annular plate 122, and a plurality of blades 123 disposed on the upper side and the lower side of the annular plate 122 and circumferentially disposed around the hub 121.

However, because the blades of the impeller are arranged in the same height and have the same outer diameter, such designs will limit the air flowing way and their application.

SUMMARY OF THE INVENTION

According to one aspect of the present invention, the heat-dissipating device includes a housing having at least one opening, and a rotor disposed in the housing and having a base, a hub, a first set of blades disposed around the hub, and a second set of blades disposed on the base.

Preferably, the first set of blades extends downward from a periphery of the hub to a surface of the base. The first and second sets of blades are alternately arranged.

Alternatively, the first and second sets of blades are correspondingly partially connected with each other.

Preferably, the first and second sets of blades are shaped as curved or airfoil structures, respectively.

Preferably, the first and second sets of blades are correspondingly connected with each other and bent to different directions.

The base, the hub, the first and second sets of blades are integrally formed as a single unit. Alternatively, the hub and the first set of blades are integrally formed as a first unit, and the base and the second set of blades are integrally formed as a second unit to be assembled with the first unit.

In addition, the housing further includes a first frame for accommodating the rotor therein, and a second frame coupled to the first frame, provided with the opening and having a sidewall extending from a periphery of the opening inwardly to define an air-gathering chamber in the housing.

The second frame further includes a plurality of air-guiding members disposed along the sidewall for increasing a blast pressure of airflow passing through the heat-dissipating device. Preferably, the plurality of air-guiding members are shaped as strip, plate, curved, inclined or airfoil structures. Additionally, the second frame further includes a support mounted inside the opening and the plurality of air-guiding members are arranged between the sidewall and the support.

On the other hand, the first frame has a bearing tube for allowing a first bearing to be disposed therein and the support of the second frame receives a second bearing so as to jointly support a shaft of the rotor with the first bearing.

Preferably, the heat-dissipating device further includes an another set of air-guiding members disposed on an air outlet of the housing.

Additionally, the sidewall has a flange radially extending from one end thereof to define an entrance of the air-gathering chamber, and each of the blades has an end extending toward the entrance of the air-gathering chamber for guiding the airflow into the air-gathering chamber.

Preferably, the air-gathering chamber partially or completely overlaps an air passage through the rotor in height along an axis of the heat-dissipating device. The cross-sectional area of the air-gathering chamber is substantially equal in size to that of an air outlet of the housing.

The second frame has an extending part formed on an inner surface thereof and extending toward a direction of the first frame to form an axially compressed airflow passage in the housing.

According to another aspect of the present invention, the heat-dissipating device includes a housing having an air inlet and an air outlet, and a rotor disposed in the housing, and having a first set of blades and a second set of blades, both of which have upper edges facing to the air inlet and positioned at different heights.

BRIEF DESCRIPTION OF THE DRAWINGS

The present invention is more fully understood by reading the subsequent detailed description and examples with references made to the accompanying drawings, wherein.

DETAILED DESCRIPTION OF THE INVENTION

Figure 3:
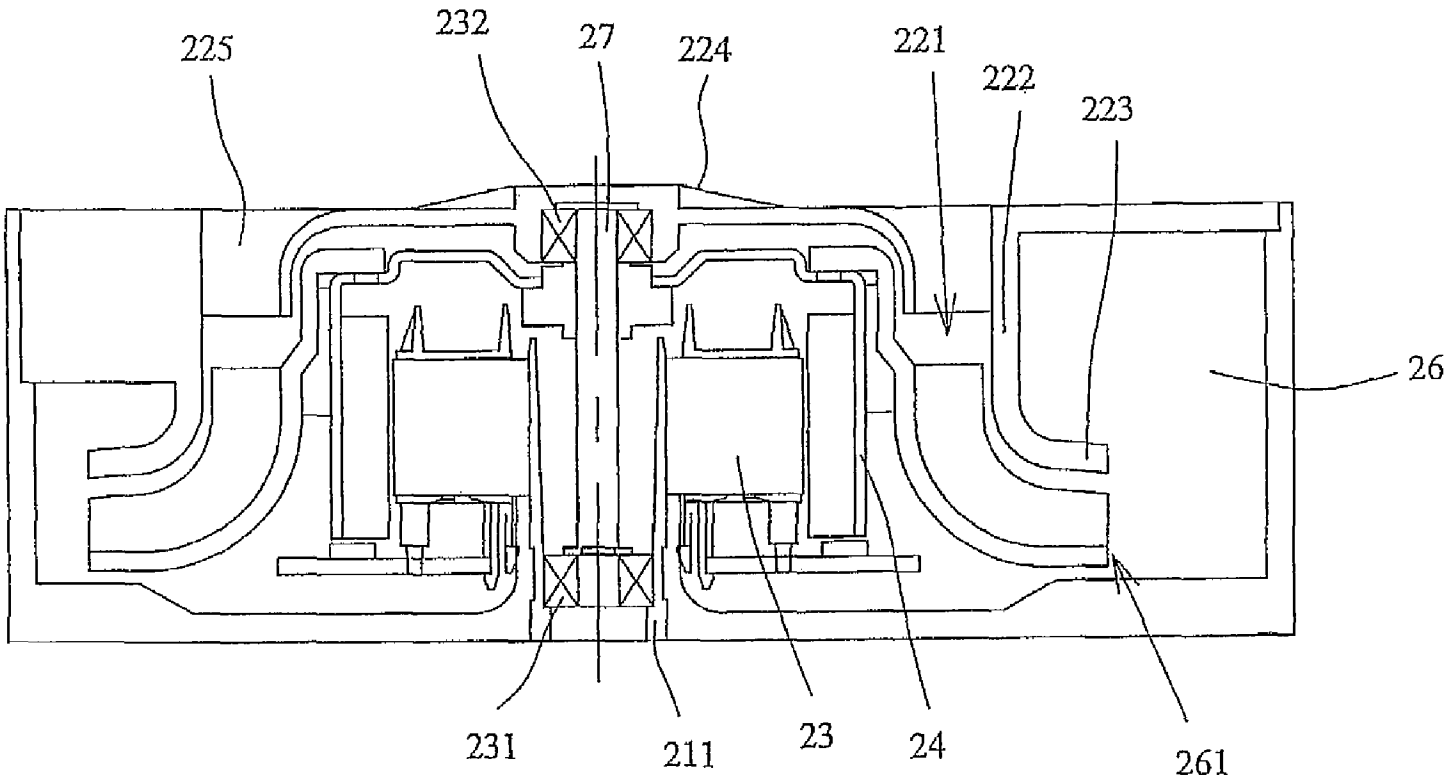
FIG. 3 is a sectional view of the heat-dissipating device of FIG. 2 after being assembled.
Figure 4:
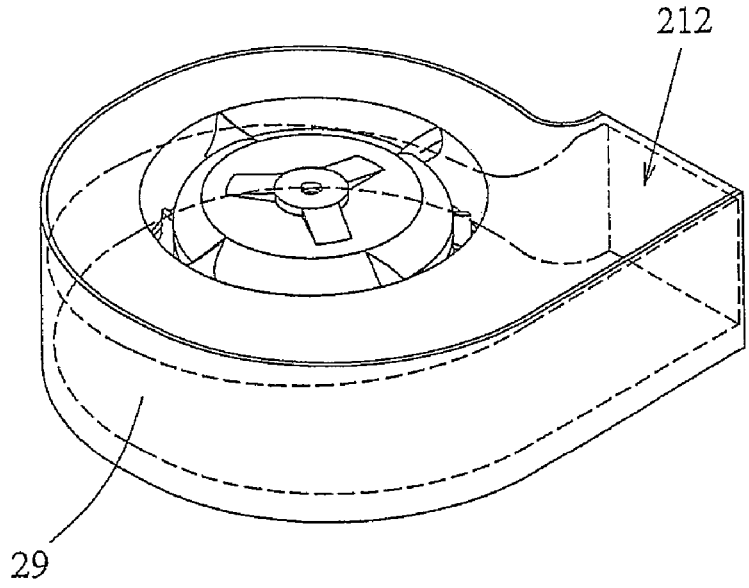
FIG. 4 is a perspective view of a heat-dissipating device of FIG. 2 after being assembled.

Please refer to FIGS. 3 and 4, showing the first embodiment of the heat-dissipating device of the present invention. The heat-dissipating device is exemplified by a centrifugal fan, which is a single-suction blower. The design way of the present invention can also be applied to the axial-flow fan. The heat-dissipating device includes a housing constituted by a first frame 21 and a second frame 22, a driving device 23, a metallic shell 24 and a rotor 25.

The first frame 21 includes a bearing tube 211 for receiving and supporting the driving device 23 and the bearing 231 is mounted inside the bearing tube 211 for supporting a rotating shaft 27 of the rotor 25. The second frame 22 includes an air inlet 221 and a sidewall 222 extending downward from an inner margin of the air inlet 221. When the first frame 21 and the second frame 22 are assembled together, a space will be formed inside the heat-dissipating device and can be divided to an air-gathering chamber 26 and a partition for disposing the rotor 25 therein by the sidewall 222. An air outlet 212 is also formed simultaneously as shown in FIG. 4. A flange 223 is radially extending from the bottom of the sidewall 222 to define an entrance 261 of the air-gathering chamber 26.

Figure 2:
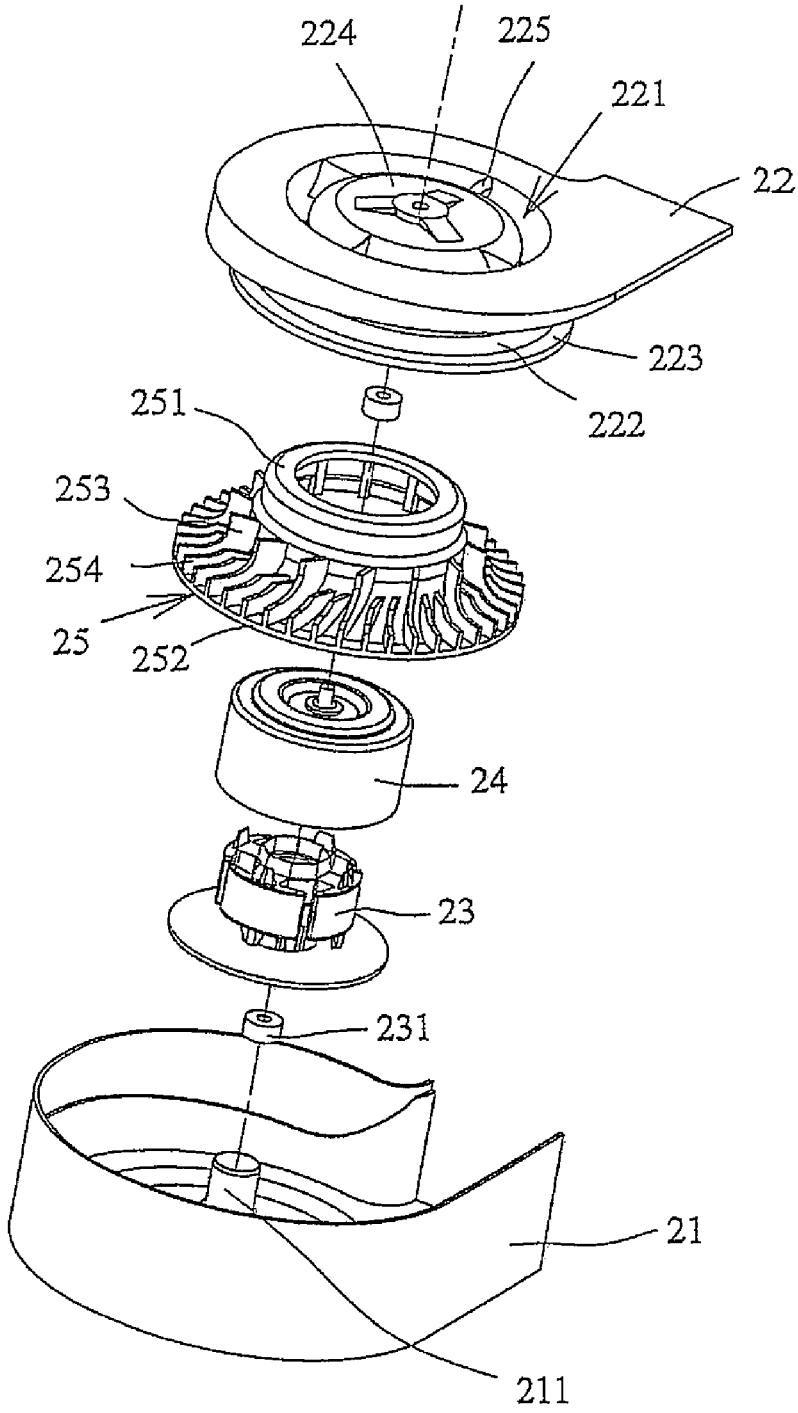
FIG. 2 is an exploded view of a heat-dissipating device according to an embodiment of the present invention.

The rotor 25 includes a hub 251, a base 252 radially extending from the bottom end of the hub 251, a first set of blades 253 and a second set of blades 254, and is driven by the driving device 23 coupled inside the hub 251. The first and second sets of blades 253, 254 are curved blades disposed on the base 252, respectively, and each blade has one end extending toward the entrance 261 of the air-gathering chamber 26, wherein the first set of blades is extended downward from the outer periphery of the hub 251 to the surface of the base 252. The first and second sets of blades are alternately arranged as shown in FIG. 2. The hub 251, the base 252 and the blades 253, 254 can be integrally formed as a monolithic piece by injection molding.

The second frame 22 further has a support 224 mounted inside the air inlet and a plurality of air-guiding members 225 are disposed between the support 224 and the sidewall 222 for increasing the blast pressure of the heat-dissipating device.

As the rotor 25 rotates, the airflow is intaked into the air inlet 221, passes through the air-guiding members 225 and the blades 253, 254, and is guided into the air-gathering chamber 26 via the entrance 261. In the air-gathering chamber 26, the airflow is gradually collected and discharged therefrom to the exterior at a high pressure via the air outlet 212, which can prevent the sudden change of the airflow pressure. Thus, the airflow sequentially passes through the air inlet 221, the air-guiding members 225, the blades 253, 254 and the entrance 261 of the air-gathering chamber 26.

Because the sidewall 222 extends downward from the inner margin of the air inlet 221 and separates the air-gathering chamber 26 from the rotor 25 and the size of the air outlet 212 is reduced, time of airflow pressurization by the rotor 25 is increased such that the variation in airflow pressure are stabilized. Further, because the height of the air-gathering chamber 26 partially or completely overlaps that of the flow passage through the rotor 25 and the air-guiding members 225 in the axial direction, the occupied space of the centrifugal fan can be minimized. The cross-sectional area of the air-gathering chamber 26 is substantially equal in size to that of the air outlet 212 such that airflow can constantly and stably flow within the air-gathering chamber 26 and the air outlet 212 to prevent work loss.

On the other hand, the present invention adopts a two-side motor fixed design, as shown in FIG. 2B, the bearing 231 is mounted inside the bearing tube 211 and the other bearing 232 is mounted on the inner side of the support 224 of the second frame 22 for jointly supporting the shaft 27 of the rotor 25 so as to provide the stabilization of the centrifugal fan under the high-speed operation and eliminate the vibration.

In addition, the second frame 22 has an extending part 29 formed on an inner side thereof and axially extending toward the direction of the first frame 21 to form an axially compressed airflow passage in the housing as shown in FIG. 2 or 4.

Figure 5:
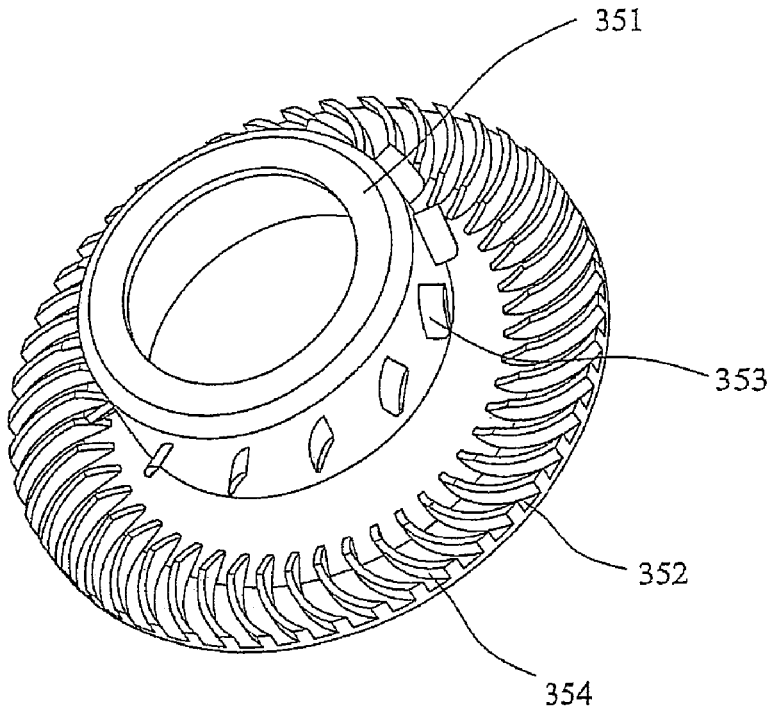
FIGS. 5 and 6 are the perspective views of another two kinds of the blade structures used in the present invention.
Figure 6:
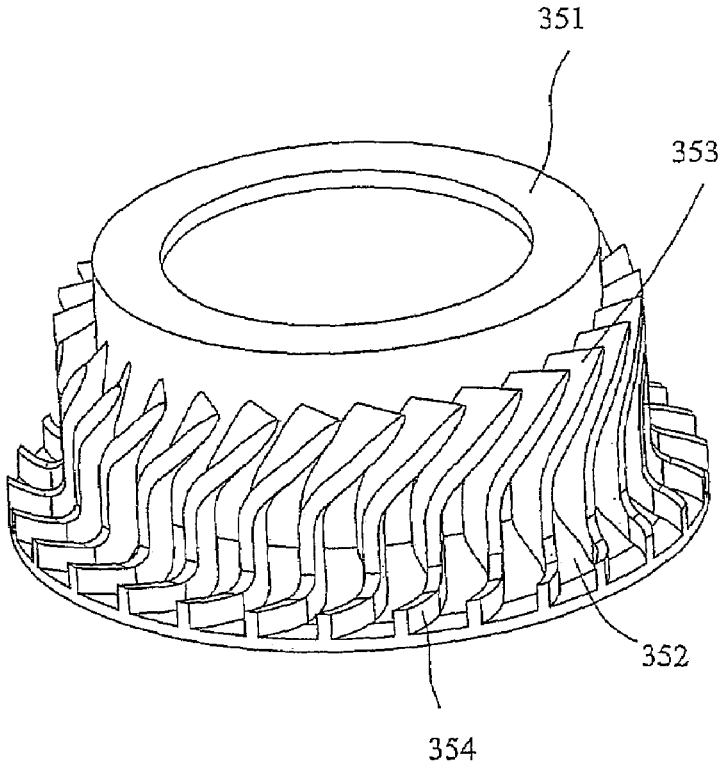

Certainly, the size, shape, and arrangement of the blade structure of the rotor include but not limited to those shown in FIG. 2. In the arrangement and disposition, the composite blade structures can be partially or completely connected with each other. All sets of blades can be located on the same or opposite sides of the rotor. For example, the first and second sets of blades 353, 354 are up-and-down arranged, as shown in FIG. 5, wherein the first set of blades 353 is disposed around the hub 351 and each blade has an airfoil structure; and the second set of blades 354 is disposed on the surface of the base 352 and each blade has a curved structure with an upper edge of different heights. The size, shape, and number of the first set of blades are unequal to those of the second set of blades. The hub 351, the base 352, the first set of blades 353, and the second set of blades 354 can integrally formed as a single unit. Alternatively, the hub 351 and the first set of blades 353 are formed as a first unit, and the base 352 and the second set of blades 354 are formed as a second unit. Finally, the first and second units are assembled together to constitute a rotor. In addition, the composite blade structure of the rotor can be designed as that shown in FIG. 6, wherein the first set of blades 353 and the second set of blades 354 are correspondingly connected with each other and curved or bent to two opposite directions.

Figure 7:
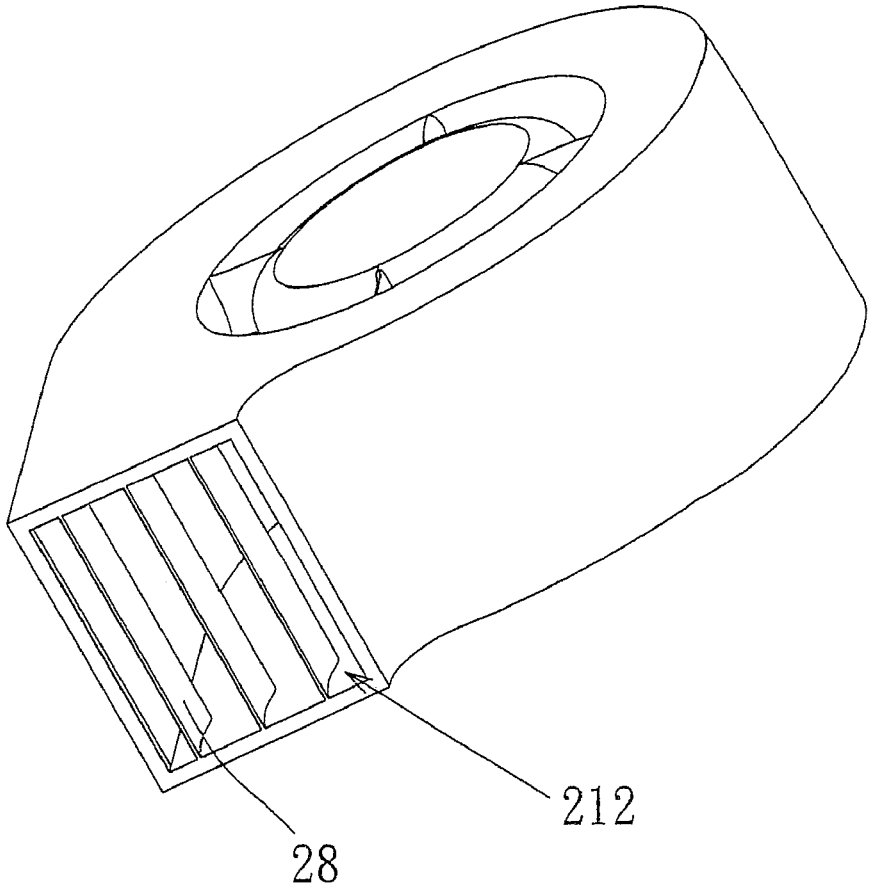
FIG. 7 is a perspective view of a heat-dissipating device according to another embodiment of the present invention.

The above-described air-guiding members 225 can be disposed on the air inlet, but another similar air-guiding members 28 can also be mounted on the air outlet 212 as shown in FIG. 7. The number, shape and arrangement of the air-guiding members can be modified or selected according to the actual application. The plurality of air-guiding members can be shaped as strip, plate, curved, inclined or airfoil structures. In addition, if the aspect of the present invention is applied to an upside-down blower, a two-suction blower or an axial-flow fan, the air-guiding members 225 can be disposed on one of the air inlets or both.

Figure 1:
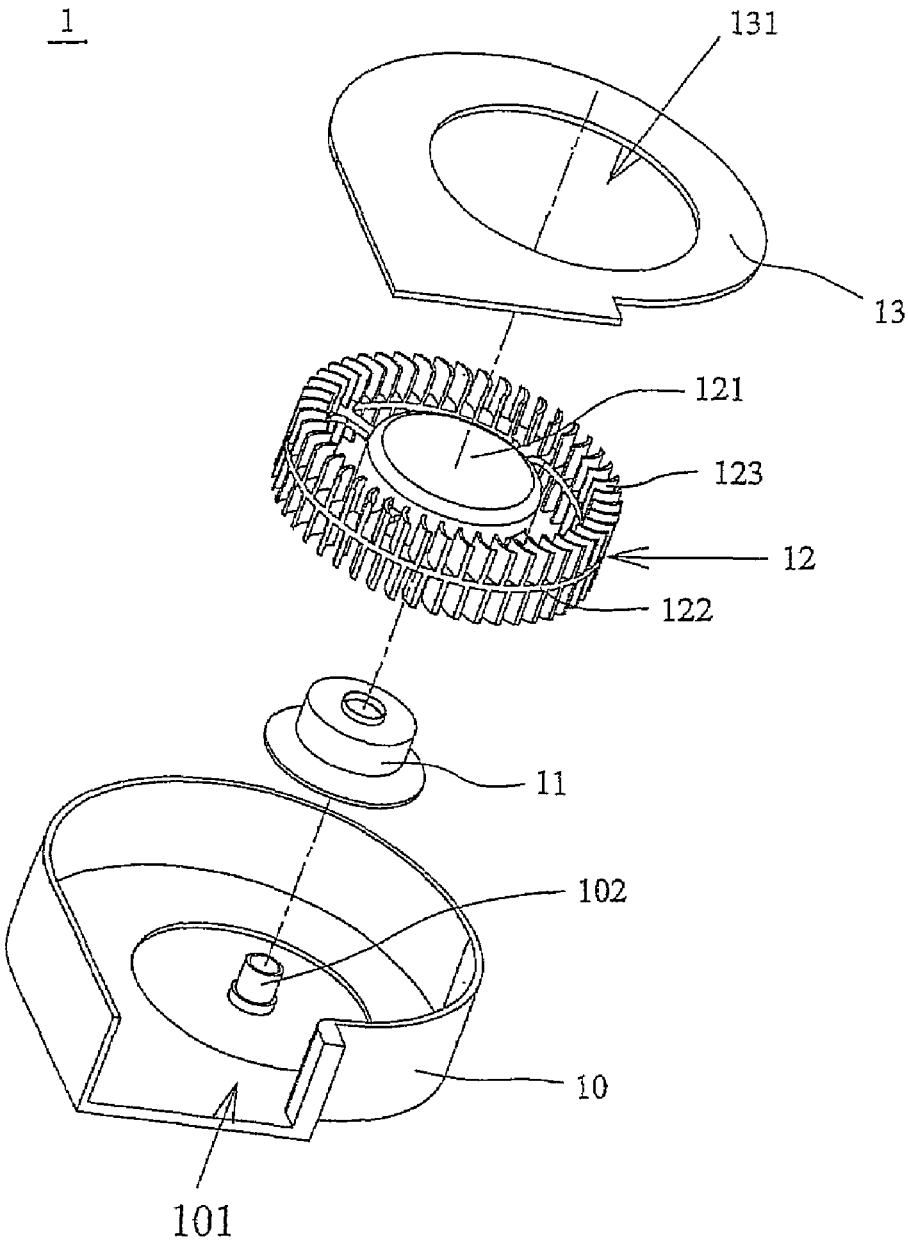
FIG. 1 ( PRIOR ART )
FIG. 1 is an exploded view of a conventional blower.
Figure 8:
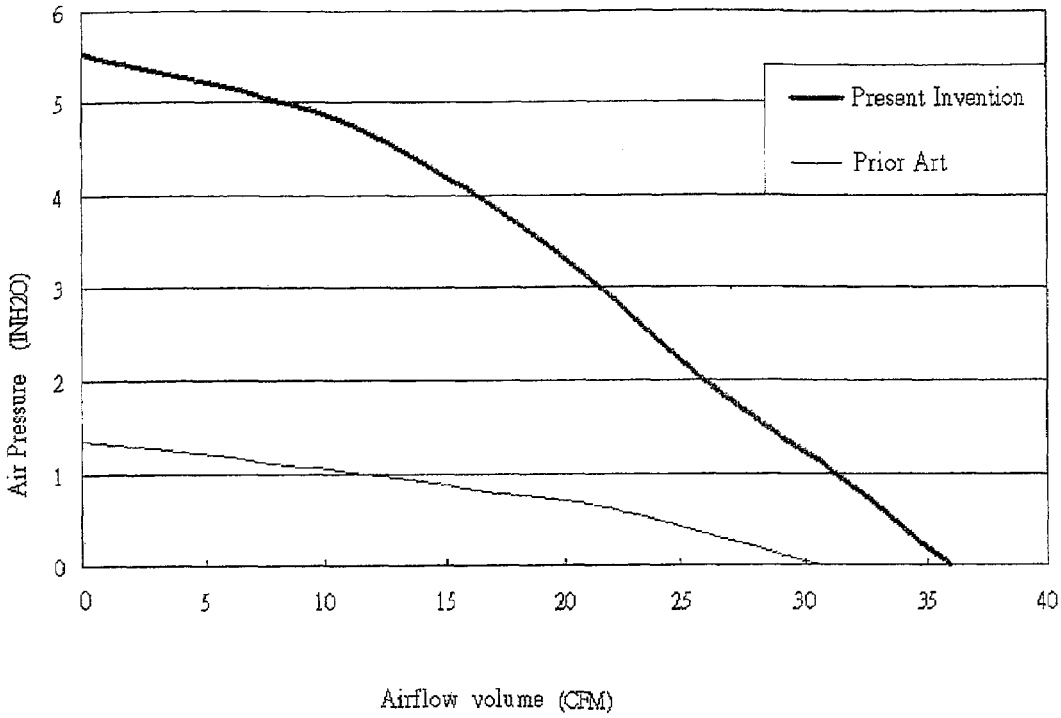
FIG. 8 shows the airflow volume and pressure comparison between the conventional blower of FIG. 1 and the heat-dissipating device of the present invention shown in FIG. 2.

Finally, please refer to FIG. 8 which shows the comparison of the airflow pressure and volume between the centrifugal fan of the invention shown in FIGS. 2, 3 and 4 and the conventional blower of FIG. 1. This figure can demonstrate that the airflow pressure and volume of the centrifugal fan of the invention can be greatly increased by the air-guiding members, the composite blade structures, and the air-gathering chamber, thereby enhancing its performance and heat-dissipating efficiency.

While the invention has been described in connection with what is presently considered to be the most practical and preferred embodiment, it is to be understood that the invention is not limited to the disclosed embodiments, but, on the contrary, is intended to accommodate various modifications and equivalent arrangements included within the spirit and scope of the appended claims.

What is claimed is:

1. A heat-dissipating device, comprising:

a housing having at least one opening;

a rotor disposed in the housing and having a base, a hub; a first set of blades disposed around the hub, and a second set of blades disposed on the base; and a driving device disposed inside the hub, wherein the housing has a sidewall and a flange radially extending from the bottom of the sidewall to define an entrance of an air-gathering chamber, the entrance is between the flange and the bottom of the housing, and the air-gathering chamber is between the sidewall and a peripheral wall of the housing, and wherein an outermost end of the flange is vertically aligned with an outermost end of at least one of the first set of blades and the second set of blades.

2. The heat-dissipating device of claim 1, wherein the first set of blades extends downward from a periphery of the hub to a surface of the base.

3. The heat-dissipating device of claim 2, wherein the first and second sets of blades are alternately arranged.

4. The heat-dissipating device of claim 1, wherein the first and second sets of blades are correspondingly partially connected with each other.

5. The heat-dissipating device of claim 1, wherein the first and second sets of blades are shaped as curved or airfoil structures, respectively.

6. The heat-dissipating device of claim 1, wherein the first and second sets of blades are correspondingly connected with each other and bent to different directions.

7. The heat-dissipating device of claim 1, wherein the base, the hub, the first and second sets of blades are integrally formed as a single unit.

8. The heat-dissipating device of claim 1, wherein the hub and the first set of blades are integrally formed as a first unit, and the base and the second set of blades are integrally formed as a second unit to be assembled with the first unit.

9. The heat-dissipating device of claim 1, wherein the housing further comprises:

a first frame for accommodating the rotor therein; and a second frame coupled to the first frame, provided with the opening and having the sidewall extending from a periphery of the opening inwardly to define the air-gathering chamber in the housing.

10. The heat-dissipating device of claim 9, wherein the second frame further comprises a plurality of air-guiding members disposed along the sidewall for increasing a blast pressure of airflow passing through the heat-dissipating device.

11. The heat-dissipating device of claim 10, wherein the plurality of air-guiding members are shaped as strip, plate, curved, inclined or airfoil structures.

12. The heat-dissipating device of claim 10, wherein The second frame further comprises a support mounted inside the opening and the plurality of air-guiding members are arranged between the sidewall and the support.

13. The heat-dissipating device of claim 12, wherein the first frame has a bearing tube for allowing a first bearing to be disposed therein and the support of the second frame receives a second bearing so as to jointly support a shaft of the rotor with the first bearing.

14. The heat-dissipating device of claim 10, further comprising an another set of air-guiding members disposed on an air outlet of the housing.

15. The heat-dissipating device of claim 9, wherein the sidewall has a flange radially extending from one end thereof to define an entrance of the air-gathering chamber, and each of the blades has an end extending toward the entrance of the air-gathering chamber for guiding the airflow into the air-gathering chamber.

16. The heat-dissipating device of claim 9, wherein the air-gathering chamber partially or completely overlaps an air passage through the rotor in height along an axis of the heat-dissipating device.

17. The heat-dissipating device of claim 9, wherein the second frame has an extending part formed on an inner surface thereof and extending toward a direction of the first frame to form an axially compressed airflow passage in the housing.

18. The heat-dissipating device of claim 9, wherein a cross-sectional area of the air-gathering chamber is substantially equal in size to that of an air outlet of the housing.

19. A heat-dissipating device, comprising:

a housing having an air inlet and an air outlet;

a rotor disposed in the housing, and having a first set of blades and a second set of blades, both of which are disposed on a base of the rotor and have upper edges facing to the air inlet and positioned at different heights;

wherein the housing includes:

a first frame for accommodating the rotor therein; and a second frame coupled to the first frame, having a sidewall and a flange radially extending from the bottom of the sidewall toward the direction of the first frame to define an entrance of an air-gathering chamber, the entrance is between the flange and the bottom of the housing, and the air-gathering chamber is between the sidewall and a peripheral wall of the housing, and wherein an outermost end of the flange is vertically aligned with an outermost end of at least one of the first set of blades and the second set of blades.

20. The heat-dissipating device of claim 19, wherein the rotor further comprises a hub for connecting the first set of blades thereon and a base for mounting the second set of blades thereon.

21. The heat-dissipating device of claim 20, wherein the first set of blades extends from a periphery of the hub to a surface of the base, and the first and second sets of blades are alternately arranged.

22. The heat-dissipating device of claim 20, wherein the first and second sets of blades are correspondingly connected with each other and bent to different directions.

* * * * *